United States Patent [19]

Mandel et al.

[11] 4,400,787

[45] Aug. 23, 1983

[54] ELEVATOR SYSTEM WITH SPEECH SYNTHESIZER FOR REPETITION OF MESSAGES

[75] Inventors: Alan F. Mandel, Scott Township, Allegheny County; Kenneth M. Eichler, North Versailles, both of Pa.

[73] Assignee: Westinghouse Electric Corp., Pittsburgh, Pa.

[21] Appl. No.: 215,894

[22] Filed: Dec. 12, 1980

[51] Int. Cl.[3] ..... B66B 3/00; G10L 1/08

[52] U.S. Cl. ..... 364/513; 340/19 A; 340/692; 364/424

[58] Field of Search ..... 364/400, 424; 340/19 A, 340/692

[56] References Cited

U.S. PATENT DOCUMENTS

| | | | |
|---|---|---|---|
| 2,991,448 | 7/1961 | Diamond et al. | 340/19 A |
| 3,375,491 | 3/1968 | Hornung et al. | 340/19 A |
| 4,301,328 | 11/1981 | Dorais | 179/1 SM X |
| 4,310,825 | 1/1982 | Tsunoda et al. | 179/1 SM X |
| 4,335,379 | 6/1982 | Martin | 179/1 SM X |

FOREIGN PATENT DOCUMENTS

| | | | |
|---|---|---|---|
| 54-97950 | 8/1979 | Japan | 340/19 A |

OTHER PUBLICATIONS

Master Specialities Company: Automatic Number Announcer, Catalog No. 3041, Jul. 1973.

Master Specialities Company: Expandable Voice Annunciator F1047, Oct. 1974.

Hodges et al: The Implementation of an All Digital Speech Synthesizer, Conference Proceedings, IEEE Int. Conference on Acoustics, Speech and Signal Processing, Denver, CO, Apr. 1980, pp. 855–858.

*Primary Examiner*—Felix D. Gruber

*Attorney, Agent or Firm*—D. R. Lackey

[57] ABSTRACT

An elevator system having an elevator car, and communication apparatus which includes a speech synthesizer for each car which provides audible, informative messages in its associated elevator car in response to its operation. Messages which are repeated within a predetermined period of time have one or more parameters thereof varied, to relieve the monotony which would be otherwise caused by the repetition of identical messages presented in an identical manner, and/or, to emphasize predetermined words or phrases.

10 Claims, 13 Drawing Figures

ELEVATOR SYSTEM WITH SPEECH SYNTHESIZER FOR REPETITION OF MESSAGES

BACKGROUND OF THE INVENTION

1. Field of the Invention

The invention relates in general to elevator systems, and more specifically to elevator systems which include means for providing audible messages in a plurality of elevator cars.

2. Description of the Prior Art

In the past, audible, informative messages have been produced in elevator cars, with the messages being prerecorded on tape, or other suitable recording means. Recently, several different techniques have been developed for synthesizing human speech electronically, and speech synthesizer processor units are now available and are being applied to many different applications. In the elevator application, the greatest need for audible in-car messages is in a bank of elevators, i.e., installations having a plurality of elevator cars controlled by a central supervisory processor. While large scale integrated circuits have lowered the cost of such speech synthesizer systems, the overall cost in providing such systems for a bank of elevator cars is still appreciable, because of the plurality of cars involved. Concurrently filed Application Ser. No. 215,893, entitled "Elevator System", filed in the names of K. M. Eichler, A. F. Mandel and D. A. Bauman, which application is assigned to the same assignee as the present application, discloses and claims a new and improved elevator system which substantially lowers the cost of the use of speech synthesis in an elevator system.

In this co-pending application, a single central processing unit (CPU), a single vocabulary source, and a single message instruction source, are required for serving a plurality of elevator cars. The only per-car apparatus required for the communication system is the speech synthesizer unit, external analog filtering and amplification, and the speaker. Notwithstanding the fact that the message center, vocabulary source, and CPU are common to all of the cars of the bank of cars, audible messages may be simultaneously provided in all of the cars by an "interleaving" arrangement which permits different, or like, audible, informative messages to be produced without interruption. The present invention is an improvement on speech synthesis systems for elevators, which improvement may be used by the system disclosed in the co-pending application.

SUMMARY OF THE INVENTION

Briefly, the present invention is a new and improved elevator system including an elevator car, and a speech synthesis communication system for the elevator car. Audible, informative messages are prepared and delivered in and/or adjacent to the elevator car in response to certain status signals which inform passengers, or prospective passengers, of the status of the elevator car, and/or building status. When a certain message has been delivered in response to a status signal, the condition which initiated the status signal may still persist, resulting in the need for the information in the message to be replaced. Thus, the same status signal is forced true. According to the teachings of the invention, a predetermined parameter, or parameters, of the repeated message is varied to either prevent a monotonous repetition of exactly the same message audibly delivered in exactly the same manner, and/or to change the emphasis or urgency of the message. This predetermined parameter, for example, may be word order, message length, volume change of the whole message, or selected words thereof, and/or the reverberation of the whole message, or selected words thereof. Any one or more of these parameters, in any combination, may be varied.

In addition to varying a predetermined parameter, or parameters, the invention also assures that the passengers, or prospective passengers, receive the message. In one embodiment, the volume of a message is automatically increased in response to the elevator car standing adjacent to a floor with its doors open, which floor is known to have a high noise background level, such as a lobby floor or a restaurant floor. On the other hand, the message volume may be reduced when the elevator car is standing adjacent to a floor which is unusually quiet, and requires a low noise level, such a library floor. In another embodiment, a microphone detects the level of background noise and automatically adjusts the volume of the message via an automatic gain control circuit which is responsive to the detected noise level.

BRIEF DESCRIPTION OF THE DRAWINGS

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

Figure 5:
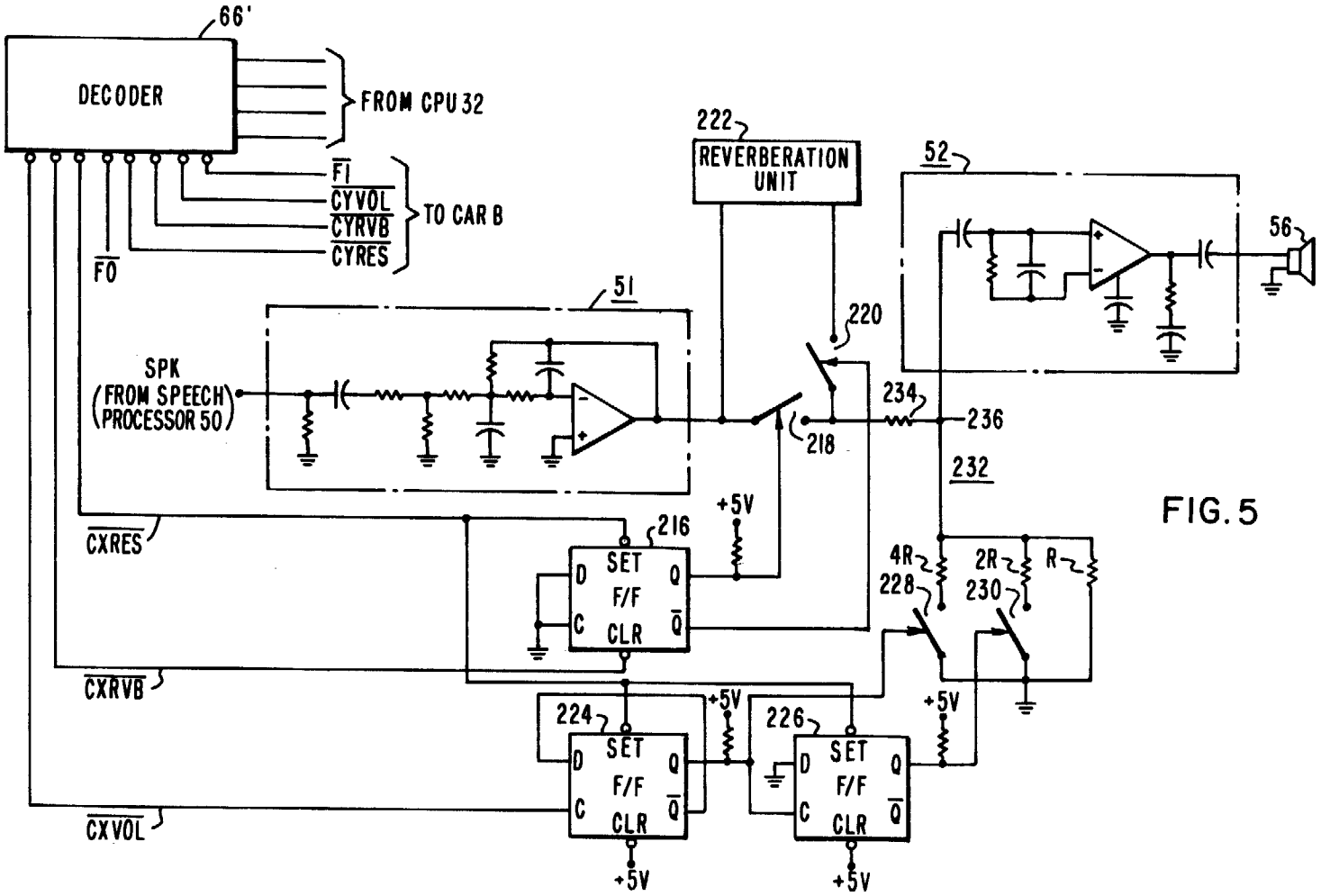
FIG. 5 is a schematic diagram which illustrates how the elevator system of FIG. 1 may be modified to carry out certain teachings of the invention related to volume control and message reverberation.

Referring now to the drawings, and to FIGS. 1 and 5 in particular, there is shown an elevator system 10 constructed according to the teachings of the invention. Elevator system 10 includes one or more elevator cars, with two cars referenced car A and car B, being shown for purposes of example. In order to set forth an elevator system which may be modified to use the teachings of the invention, the elevator system of the hereinbeforementioned co-pending application will be used. The invention of this co-pending application, unlike the present invention, requires two or more elevator cars, and thus certain of the description to be used herein will refer to more than one elevator car in the system. The present invention, however, may be applied to a single elevator car.

The elevator cars are mounted for movement in hatchways of a building 12 having a plurality of floors, shown generally at 14. The elevator cars may be driven by the traction system illustrated, or by any other suitable drive arrangement, such as hydraulic. In the traction arrangement, car A is connected to a counterweight 16 via a plurality of wire ropes 18 which are reeved about a drive sheave 20. Drive sheave 20 is driven by a drive machine 22, which may include a DC motor and a suitable DC power supply, or an AC motor and a suitably controlled AC supply voltage.

Each elevator car has like car controls, such as a car controller 24 for car A, which includes a floor selector and a speed pattern generator. In order to prevent each elevator car from responding to a hall call, they may in turn be controlled by supervisory control which causes the elevator cars to handle hall calls in an efficient manner, according to a predetermined strategy. The specific details of the elevator car controllers and the supervisory control are not important to the present invention, and thus they are not shown in order to limit the length and complexity of the application. For example, suitable car controllers are set forth in U.S. Pat. Nos. 3,750,850, and 3,902,572, and suitable supervisory controllers are set forth in U.S. Pat. Nos. 3,851,733, 4,007,812 and 4,037,688, all of which are assigned to the assignee of the present application. For purposes of the present invention, it is only necessary that the various car controllers prepare predetermined status signals responsive to the operation of their associated elevator cars, which status signals, when true, each indicate to a speech synthesizer system 30 that a specific verbal message should be prepared and audibly reproduced. The status signals, for most elevator related messages, are already available in the car controllers and/or supervisory control of an elevator system, while others may be produced by simple logic in response to the already available operational signals produced during the normal operation and control of the elevator system. Examples of status signals which are already available, or reproducible from already available signals, are set forth in Table I. Suitable associated messages which may be produced in response thereto, are also set forth in Table I. The elevator signals used for purposes of example may be found in the systems of U.S. Pat. Nos. 3,902,572 and 4,007,812. The former U.S. Patent sets forth car controls, and the latter U.S. Patent sets forth supervisory control for a plurality of cars. The elevator signals used in Table I are listed in Table II, along with their function.

TABLE I

| Status Signal Issued In Response To Elevator Signals | Message |
|---|---|
| $81U \cdot 80C \cdot \overline{45R}$ | Going up |
| $81D \cdot 80C \cdot \overline{45R}$ | Going down |
| NEXT | This car is next up |
| $\overline{NEXT}$ · car call button is pressed | This car is not next |
| $34R \cdot 23R$ | This car is stopping at floor ____ |
| LW | This car is fully loaded |
| $\overline{70T} \cdot \overline{45R}$ | The doors are going to close |
| Door safety edge held for predetermined time | Please allow the doors to close. |

TABLE II

| Elevator Signal | Function |
|---|---|
| 23R | The car is running |
| 34R | The car is going to stop |
| $\overline{45R}$ | The doors are fully open |
| $\overline{70T}$ | Door non-interference time has expired |
| 80C | The car is going to make a run |
| 81U | The car is going to travel up |
| 81D | The car is going to travel down |
| $\overline{NEXT}$ | This car is the next to leave main floor |
| NEXT | Car is at main floor but it is not next |
| LW | The car is fully loaded |

The floor position of a stopped elevator car, and the floor at which a moving elevator is going to stop, may be communicated to the speech synthesizer apparatus 30 from the car controllers as a digital count, or, as will be hereinafter described, the speech synthesizer apparatus 30 may maintain its own floor position counter in memory using elevator signals B69, T69, N, 81U and 81D. Signals B69 and T69 are true when the elevator car is at the bottom and top floors, respectively, and these signals may be used to reset the floor position count. Signal N changes logic state each time the selector notches into another floor, with this signal being used to advance, or decrement, the floor position counter according to travel direction, as indicated by signals 81U and 81D.

More specifically, the speech processor apparatus 30 includes a single central processor unit (CPU) 32, a single source 34 of vocabulary information, which is stored in a read-only-memory (ROM), a single source 36 of message instructions for all messages, also referred to as a phrase table, which is also stored in ROM, a random access memory (RAM) 38, and a power supply 40. The speech processor apparatus listed to this point is common to all of the elevator cars, and may be INTEL's SBC80/24 microprocessor board, for example, in which the CPU is the 8085. Additional ROM, as required for storing the speech patterns for the predetermined vocabulary, may be added to the basic 80/24 board via an SBC multi-bus.

Figures 1A, 1C:
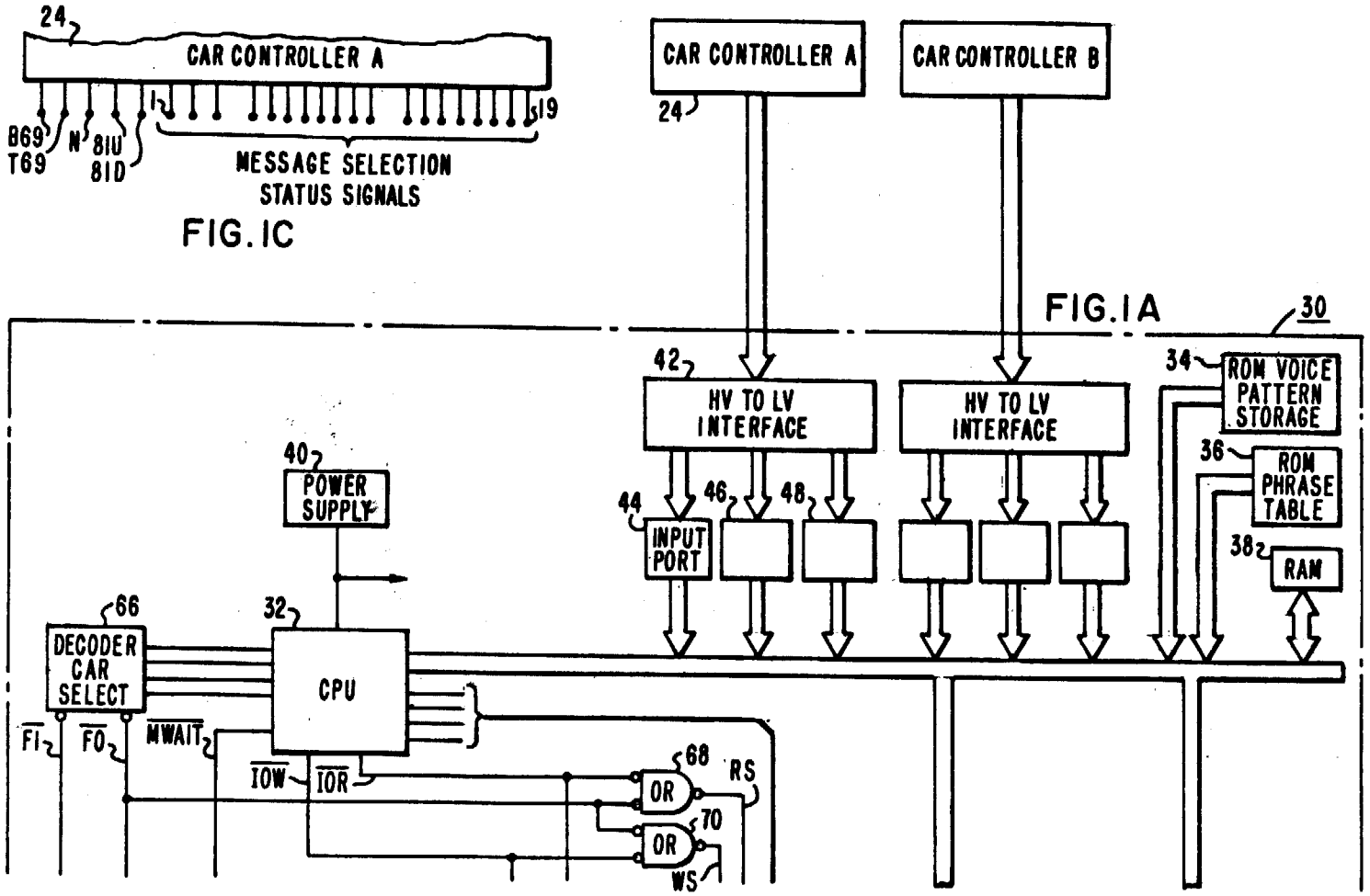
FIGS. 1A and 1B may be combined to provide a partially schematic and partially block diagram of an elevator system which may utilize the teachings of the invention.
FIG. 1C is an enlarged portion of FIG. 1A, illustrating a typical status signal output of an elevator car to the speech processor unit.
Figure 1B:
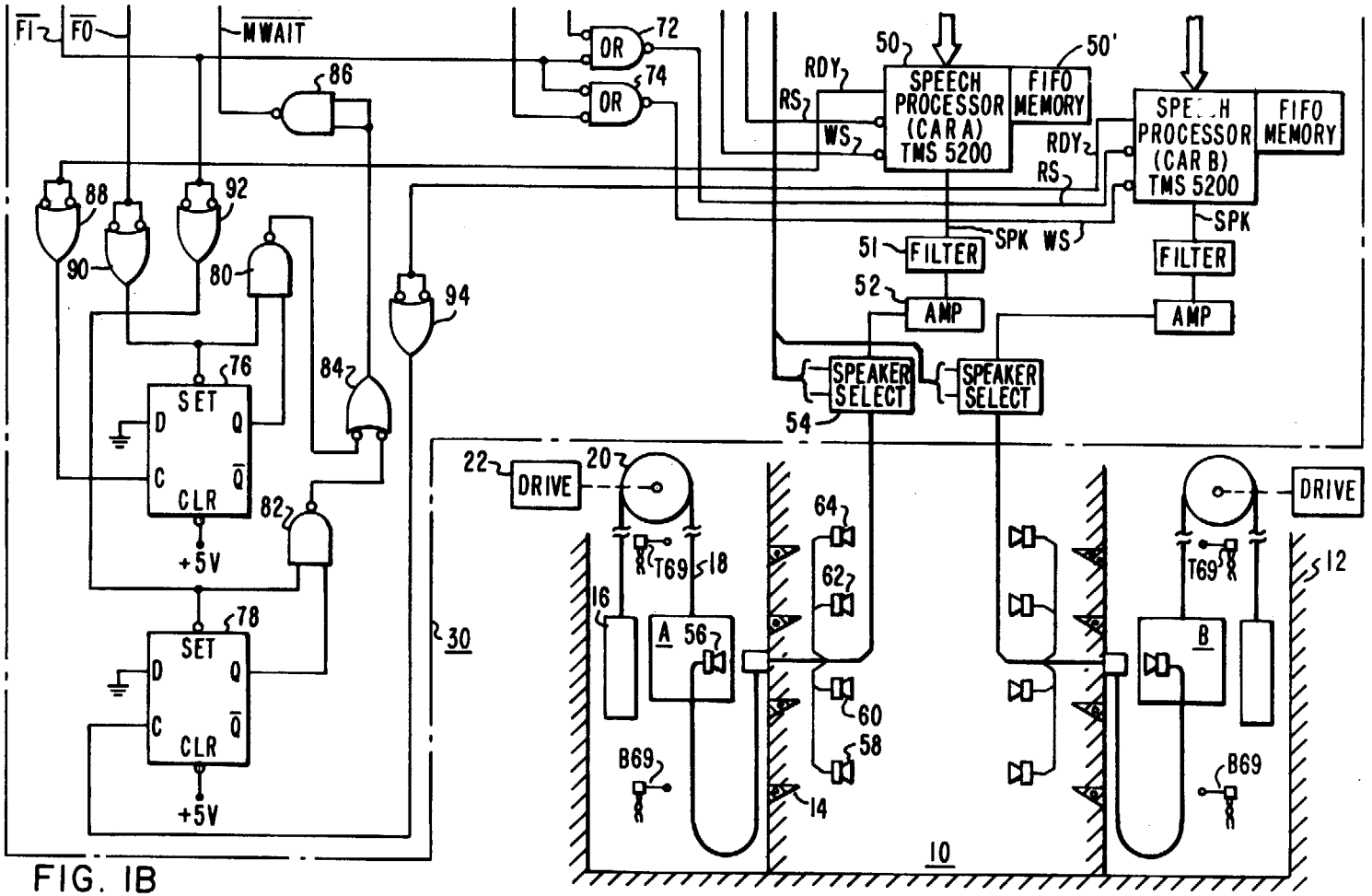

The per-car equipment in speech synthesizer apparatus 30 includes a high voltage-to low voltage interface, such as interface 42 for car A, and a plurality of input ports, such as input ports 44, 46 and 48 for car A. The interface 42 is a 24 channel, optically isolated 125 volt D.C. to 5 volt D.C. interface. Thus, up to 24 car status signals at the 125 volt D.C. level may be provided by each car controller, such as car controller 42, which signals are changed to the 5 volt logic level by interface 42 and applied to input ports 44, 46 and 48, with each input port receiving eight of the status signals. The input ports may be INTEL's 8212. As shown in FIG. 1C, which is an enlarged fragmentary view of the output of car controller 24, the first five status signals may be the signals CPU 32 requires to keep track of each car's floor position, while the remaining status signals may be message selection signals numbered in ascending order starting from the left.

Additional per-car equipment includes a speech processor for each car, such as speech processor 50 for car A. For purposes of example, it will be assumed that speech processor 50 is T.I.'s TMS5200, which includes a FIFO RAM 50' having a capacity of 16 bytes. The per-car equipment is completed by an analog filter 51 and power amplifier 52, a speaker select function, if desired, illustrated at 54 for car A, and audio speakers. The audio speakers include at least one speaker in each elevator car, such as speaker 56 in car A. If desired, a speaker may also be disposed at each floor, close to the hatch door opening for each car, such as behind, or in place of, the hall lantern or car position indicator. For example, floor speakers 58, 60, 62 and 64 are shown associated with car A. If no speakers are desired at the floors, the speaker select function 54 would not be required.

Each speech processor 50 includes read and write inputs RS and WS, respectively, an output RDY which goes low when the speech processor is ready to receive information during a "write" operation, or when it is ready to provide an output during a "read" operation, and an output SPK which is the audio information in analog form ready for filtering, amplification and reproduction.

As will be hereinafter explained, CPU 32 writes vocabulary information into the FIFO memory 50 of each speech processor 50, selecting the desired speech processor by applying a low signal to its write input WS. The speech processor 50 can only receive information at a predetermined rate, and the speech processor signals when it is ready to receive information by causing its RDY output to go low. The speech processor 50 also sets certain internal bits which may be read by CPU 32. For example, when its FIFO memory is less than one-half full, it sets a bit to signify this fact. Also, an internal code in the vocabulary information indicates to the speech processor when the phrase it is speaking has been completed, and the speed processor sets an internal bit to indicate that it has "finished talking".

CPU 32 selects the desired car via a decoder 66, such as TI's 74LS42. CPU 32 outputs 0000 when it selects car A, and 0001 when it selects car B, with output $\overline{FO}$ of decoder 66 going low to select car A, and an output $\overline{FI}$ goes low to select car B. Additional outputs of decoder 66 are used in the embodiment of the invention set forth in FIG. 5, as will be hereinafter explained.

Read and write commands $\overline{IOR}$ and $\overline{IOW}$, respectively, are communicated from CPU 32 to a selected speech processor 50 via a plurality of OR gates 68, 70, 72 and 74. When CPU 32 desires to read speech processor 50, its output $\overline{IOR}$ goes low and signal $\overline{FO}$ goes low, causing OR gate 68 to output a low signal which is the true input required by the read input RS of speech processor 50. The condition of the settable bits in speech processor 50 are then conveyed to the CPU via the data bus.

When CPU 32 desires to write information into speech processor 50, its output $\overline{IOW}$ goes low and signal $\overline{FO}$ goes low, causing OR gate 70 to provide a low true output to input WS of speech processor 50. When speech processor 50 is ready to receive the data, its output RDY goes low. Its RDY output, as well as the RDY output of the speech processor for car B, are applied to a circuit which includes first and second D-type flip-flops 76 and 78, such as T.I.'s 74LS74, and NAND gates 80, 82, 84, 86, 90, 92 and 94, such as T.I.'s 74LS00. If speech processor 50 for car A is selected, for example, and output RDY of speech processor 50 is high, flip-flop 76, which was set before signal $\overline{FO}$ went low, remains set. NAND gate 80 thus has two high inputs and it applies a low input to NAND gate 84, forcing its output high and the output of NAND gate 86 low. The low output from NAND gate 86 is applied to the $\overline{MWAIT}$ input of CPU 32, which causes CPU 32 to wait before writing or reading information relative to this speech processor. When speech processor 50 is ready for the read or write operation, its output RDY goes low, clocking flip-flop 76 to provide a low Q output. The output of NAND gate 80 goes high, and since car A has been selected, not car B, signal $\overline{FI}$ is high applying a low input to NAND gate 82 via NAND gate 92. Thus, NAND gate 84 has two high inputs and its resulting low output is inverted by NAND gate 86 to provide a high signal at input $\overline{MWAIT}$, notifying CPU 32 that speech processor 50 is ready for the requested operation.

Figure 2:
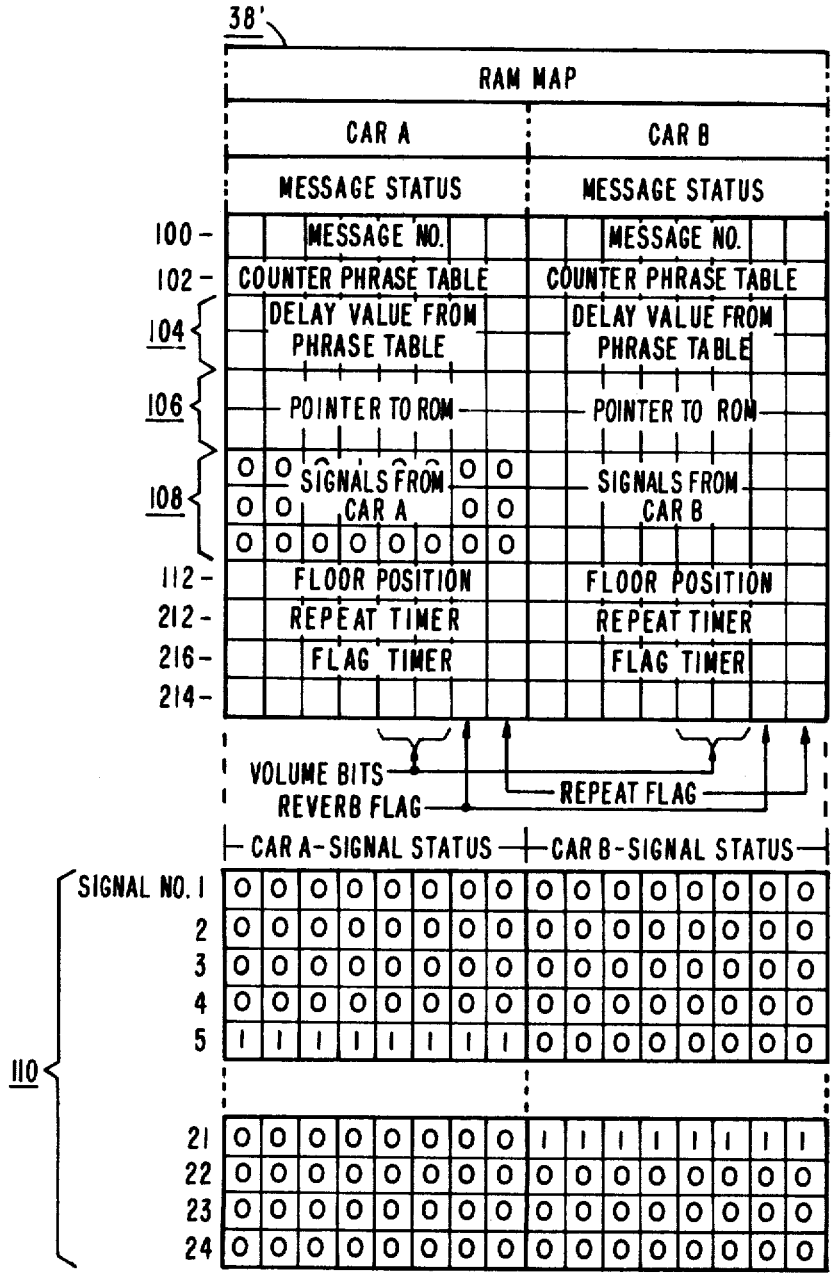
FIG. 2 is a RAM map setting fourth certain memory locations and their contents used by the elevator system shown in FIG. 1.

FIG. 2 is a RAM map illustrating the various items of information stored by CPU 32 in RAM 38 as it goes about the task of providing verbal messages in elevator cars A and B, as well as any additional cars in the bank of elevator cars. The number of elevator cars which may be handled by a single CPU is determined by the speed of the CPU and the running time of the program. The car limit is determined by calculating the number of cars which will cause a memory of a speech processor to run out of vocabulary information before completing a phrase, as the complete vocabulary information for the phrases usually includes more bytes of data than can be handled by the memory of the speech processor. A phrase may be a single word, or a group of words.

Figure 2A:
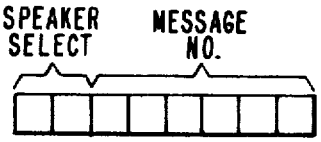
FIG. 2A illustrates a modification of the message number which may be used to additionally select the speakers to be activated for the specific message.

More specifically, CPU 32 sets up a table in RAM, 38 for each elevator car. Since the table for each car is similar, only the table for car A will be described in detail. The table for car A includes a location 100 for storing the number of the message currently being processed. If no message is currently being processed for car A, location 100 will contain 0's. If message No. 19 is being processed, for example, location 100 will contain 00010011. FIG. 2A illustrates a modification which may be used when floor speakers are utilized, as well as a car speaker. Since it will be known which speaker, or speakers should be activated for each specific message, the speaker selection may be included as part of the message number. Thus, three bits of the eight-bit message number word may be used to select the speakers, and the remaining bits used to identify the message number. Table III sets forth an example of a speaker select arrangement which may be used.

TABLE III

| Speaker Select Code | Speakers Selected |
|---|---|
| 0 0 | Car only |
| 0 1 | Car plus adjacent/target floor |
| 1 0 | Car plus all landings |
| 1 1 | Only a specific landing |

Location 102 functions as a counter which points to the present location of the program as it progresses through the list of instructions for the specific message being run. These message instructions are called the phrase table, which is stored in ROM 36.

Figure 3:
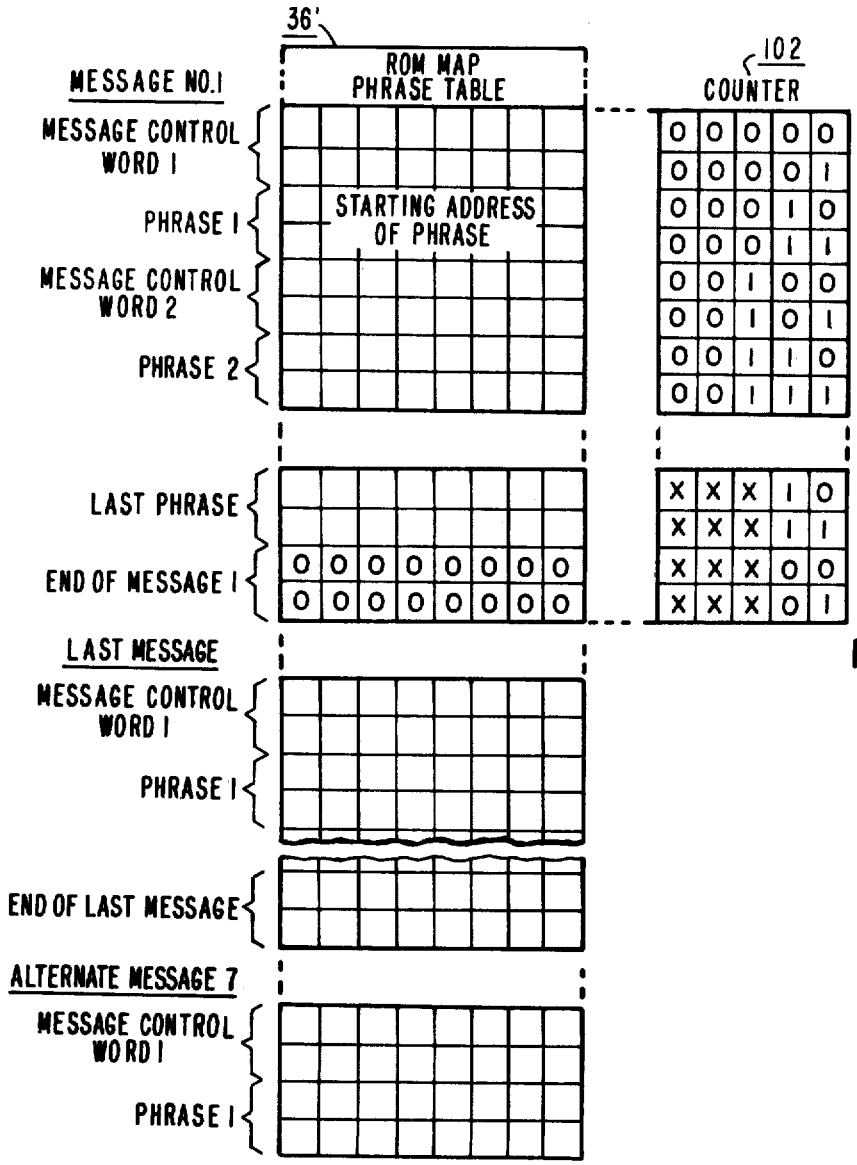
FIG. 3 is a ROM map illustrating how the instructions for each message may be stored in ROM, with the count for each byte, maintained by the counter shown in the RAM map of FIG. 2, also being shown.
Figure 3A:
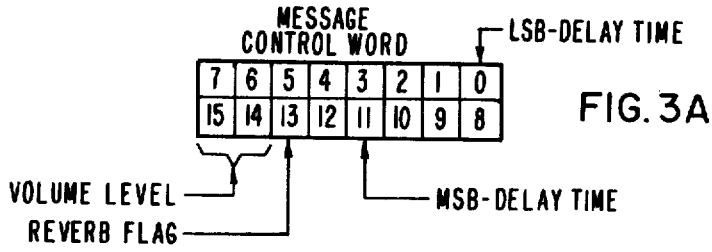
FIG. 3A illustrates the various bits of the message control word shown in FIG. 3, and their functions.

FIG. 3 is a ROM map of the phrase table. The phrase table sets forth the instructions for formulating each of the messages. In an exemplary embodiment, it will be assumed that each message will be made up from a maximum of 16 phrases, with a delay before each phrase, making a total of 32 binary words. Each of the 32 binary words is formed of two eight-bit bytes, and thus there are 64 bytes in each message. The counter in location 102 of the RAM shown in FIG. 2 starts with all 0's for byte No. 1, and it is advanced on each byte. The first two bytes, as illustrated, are a message control word instruction. The message control word instruction is reproduced in FIG. 3A in order to illustrate the functions of the various bits. Bits 0 through 11 contain a binary number signifying the length of the delay desired from the time the associated status signal goes true until the audible message begins. For example, if the status signal goes true at the start of slowdown, it may be desired to announce the floor number in the elevator car two seconds later. The binary number which will cause the message to be delayed for two seconds will form the first 12 bits of the message control word. This number is equal to the delay desired divided by the program cycle time. Bit 13 is a reverberation flag, which, when set, indicates that the immediately following phrase should be reverberated. Bits 14 and 15 are volume bits, which direct the setting of the volume of the immediately following phrase. For example, four volume levels may be selected by the bit combinations 00, 01, 10 and 11.

The next two bytes are an address instruction, containing the starting address in ROM 34 of the vocabulary information for the first phrase. As just stated, it is this phrase which is controlled by bits 13, 14 and 15 of the immediately preceding message control word. The next two bytes are the message control word for the next phrase. It selects the desired delay between phrase 1 and phrase 2, as well as selecting the volume of phrase 2, and whether or not phrase 2 is reverberated. The counter at location 100 of RAM 38 is incremented with each byte, and its count is reproduced alongside the bytes of message No. 1 in the phrase table of FIG. 3. In addition to the counter at memory location 102 always pointing to the exact location in the message instruction list to which the message has progressed, the bit next to the LSB always indicates whether the message is in a delay, or in a phrase. It will be noted that a zero at this bit location signifies the message is in the delay mode, and a one at this location signifies that the message is in a phrase mode.

The end of the message is signified by all 0's in the delay bytes, when the message ends before the end of the 64 bytes. If all 64 bytes are used, the end of the message is signified when the phrase counter at memory location 102 reaches 00111111, which signifies that all 64 bytes of instructions have been accessed.

Returning now to FIG. 2, each time a message control word instruction is encountered in the phrase table, the value of the delay found in bits 0–11 thereof is stored at location 104 so it can be decremented on each running of the program. When it is decremented to 0, the counter at location 102 is advanced two bytes to point to the next phrase in the phrase table.

The phrases in the phrase table give the starting address in ROM for the phrase in question. This starting address is stored at location 106 in RAM, and it forms a pointer to the ROM. As each byte of vocabulary information is loaded into the FIFO memory of a speech processor, the address at location 106 is incremented. Thus, after loading 16 bytes, or 8 bytes, of vocabulary into the FIFO memory, as will be hereinafter explained, the CPU can proceed to other tasks, with location 106 containing the address in ROM of the next byte to be loaded.

Location 108 in RAM 38 stores the last readings from the input ports 44, 46 and 48, and it thus requires 24 bits or 3 bytes of memory. CPU 32 uses this location to determine when a status signal goes true by comparing each input of the reading with the stored results of the last reading. If a bit location changes from a 0 to a 1, the CPU changes this bit location of memory location 108 to a 1, and it also sets a corresponding word to 1's in a "status signal acknowledged" memory located at memory location 110. Memory location 110 includes an eight-bit word for each of the 24 inputs. If input 5, for example, changes from a 0 to a 1, bit 5 of the first byte of location 108 would be changed from a 0 to a 1, and the fifth word (byte) at location 110 would be set to FF, or all 1's.

Location 112 includes the floor position of the elevator car. If the elevator car is standing, location 112 indicates the floor number at which the car is standing. If the elevator car is moving, location 112 indicates the next floor at which the elevator car can make a normal stop according to a predetermined deceleration schedule. This location may be received from an external source, or, as hereinbefore stated, it may be determined by CPU 32 from the signals applied to the first five inputs of the 24 signal inputs.

Memory location 212 holds the count of a "repeat" timer. When a message is delivered which may be subject to repetition, a count is loaded into this memory location having a value responsive to the minimum desired time spacing between repeated messages having the same information content. It is decremented to zero, and when it reaches zero, the message may be repeated if the system is requesting this message again.

Memory location 214 includes a bit referred to as the "repeat flag". When a message is delivered which is of such a nature that it may be repeated in the near future, the repeat flag is set to notify the program that this message has been given within the last predetermined number of seconds, and thus the next delivery of the message should have a predetermined parameter, or parameters, varied, as will be hereinafter explained.

Memory location 216 holds the count of a "flag" timer, which controls how long the flag bit in memory location 214 is allowed to remain set, in the absence of a repetition of the message which set it. For example, the repeat timer may be set for 5 seconds, to make sure repeated messages are at least 5 seconds apart. The flag timer may be set for 10 seconds. If the repeat request is received within 0–5 seconds of the delivery of the first running of the message, it will be delayed until 5 seconds have expired, and it will have a predetermined parameter, or parameters, varied, when it is repeated. If the repeat request is received between 5 and 10 seconds after the first running, it will be delivered immediately upon request, and it will have a parameter, or parameters, varied. If the repeat request is received more than 10 seconds later, the message will be run immediately, but it will not be varied from the first running which occurred more than 10 seconds earlier.

FIG. 5 is a schematic diagram illustrating how the elevator system 10 of FIG. 1 may be modified according to an exemplary embodiment of the invention. This modification operates in response to the reverberation and volume bits of the message control word shown in FIG. 3A. Decoder 66 shown in FIG. 1, referred to as 66' in FIG. 5, is a 4-line-to-10-line decoder, such as T.I.'s 74LS42. In addition to selecting the cars, certain outputs are used to set and clock flip-flops in response to the reverberation and volume bits of each message control word. For example, if bit 13 of the message control word is set, CPU 32 outputs a BCD word to decoder 66' which causes output $\overline{\text{CXRVB}}$ to go low. This output is applied to the clear input of a D-type flip-flop 216, such as T.I.'s 74LS74. The Q and $\overline{Q}$ outputs of flip-flops 216 are connected to the control inputs of analog switches 218 and 220, respectively, such as RCA's CD4016. Switch 218 is connected between analog filter 51 and power amplifier 52. Switch 220 connects a commercially available reverberation unit 222 across switch 218. At the end of each phrase, CPU 32 provides a reset signal $\overline{\text{CXRES}}$ via decoder 66', to set flip-flop 216. Thus, when the reverberation feature is reset by setting flip-flop 216, the high Q output of flip-flop 216 closes switch 218, and the low $\overline{Q}$ output opens switch 220. Thus, the reverberation feature is deactivated. If the reverberation bit is set, signal CXRVB is caused to go low, clearing flip-flop 216. The resulting low Q output opens switch 218 and the now high Q output closes switch 220, to connect the reverberation unit 222 between filter 51 and amplifier 52.

The volume control feature responsive to bits 14 and 15 of the message control word includes an output $\overline{\text{CXVOL}}$ from the decoder 66', its reset output $\overline{\text{CXRES}}$, first and second D-type flip-flops 224 and 226, respectively, first and second analog switches 228 and 230, respectively, and a voltage divider 232. Voltage divider 232 includes a resistor 234 having one end connected to filter 51, and its other end connected to junction 236. Junction 236 is connected to ground via three parallel connected resistors R, 2R, and 4R, with switch 228 being connected in the 4R branch and switch 230 connected in the 2R branch. Junction 236 is connected to amplifier 52. Output $\overline{\text{CXVOL}}$ from decoder 66 is connected to the clock input of the first flip-flop 224. Its $\overline{Q}$ output is connected back to its D input. Its Q output is connected to the clock input of the second flip-flop 226, and also to the control input of switch 228. The Q output of flip-flop 226 is connected to the control input of switch 230. The reset signal $\overline{\text{CXRES}}$ is applied to the set inputs of flip-flops 224 and 226.

When reset signal $\overline{\text{CXRES}}$ sets flip-flops 224 and 226, both Q outputs are high closing switches 228 and 230. This reduces the value of the parallel connected resistors to their lowest magnitude, and the signal strength applied to amplifier 52 is thus the lowest available from the voltage divider. This setting may be used as "normal" volume, or, if a "quiet" floor is in the building, this may be used as a below normal setting. If the volume control bits are 00, they select this volume level. Since this is the reset level, CPU 32 does not clock the flip-flops in response to the volume bits being 00.

If the volume control bits are 01, CPU 32 causes signal $\overline{\text{CXVOL}}$ to go low and return high once, clocking flip-flip 224, which opens switch 228 and increases the resistance of the parallel connected resistors, to thus increase the signal strength applied to amplifier 52.

If the volume control bits are 10, CPU 32 causes signal $\overline{\text{CXVOL}}$ to go low and high twice in succession, clocking flip-flop 224 twice and flip-flop 226 once, thus closing switch 228 and opening switch 230. The resistance of the parallel branch increases again, and again the signal strength applied to amplifier 52 is increased.

If the volume control bits are 11, CPU 32 causes signal $\overline{\text{CXVOL}}$ to go low and high twice in succession, clocking flip-flop 224 three times to provide a low Q output. The Q output of flip-flop 226 remains low after the first clocking. Thus, both switches 228 and 230 are open, and the parallel branch has the highest resistance, resulting in the greatest message volume.

Figure 4A:
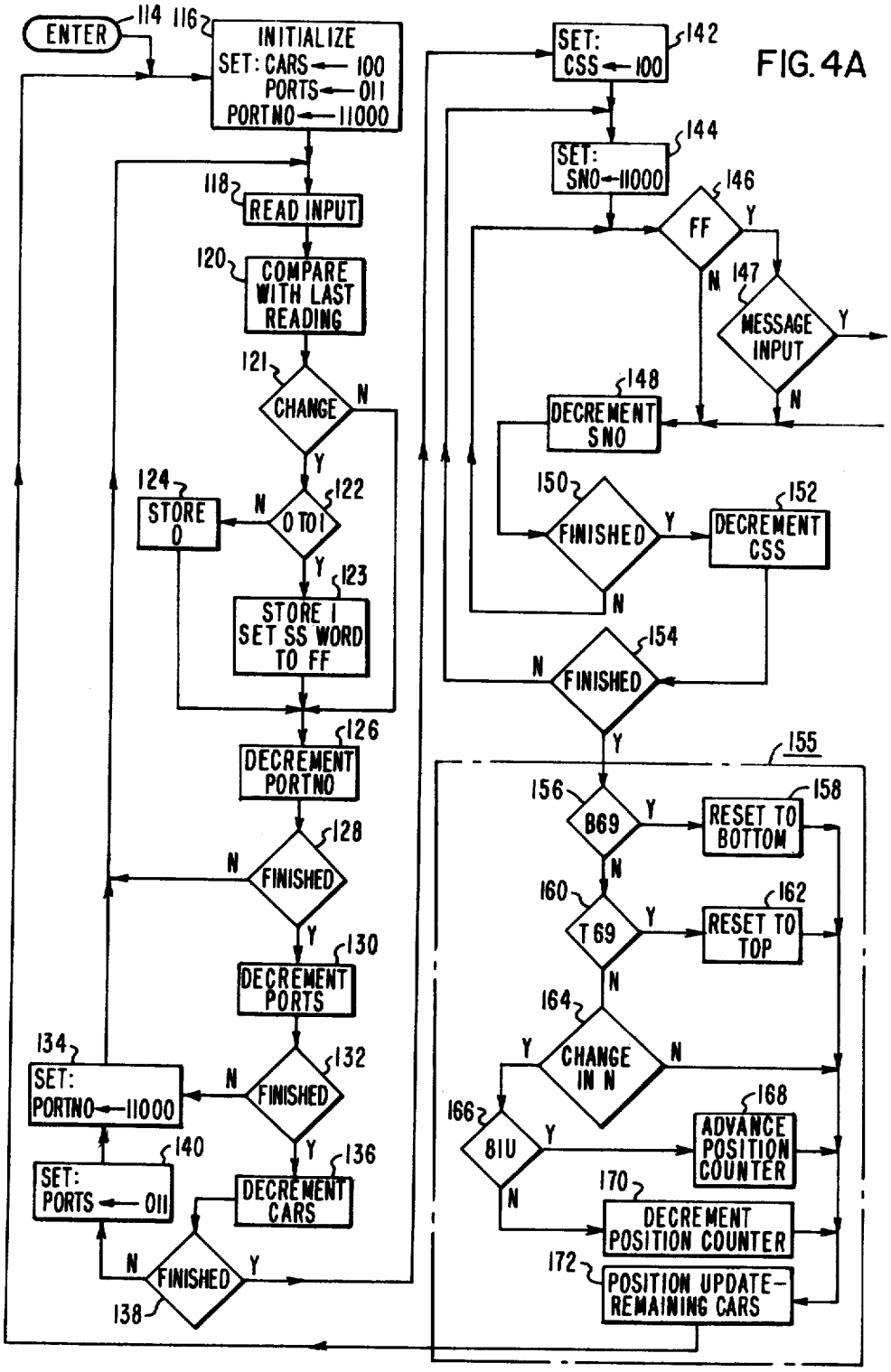
FIGS. 4A and 4B may be assembled to set forth an exemplary flow chart which may be used by the CPU shown in FIG. 1 in delivering a synthesized audible message to an elevator car.
Figure 4B:
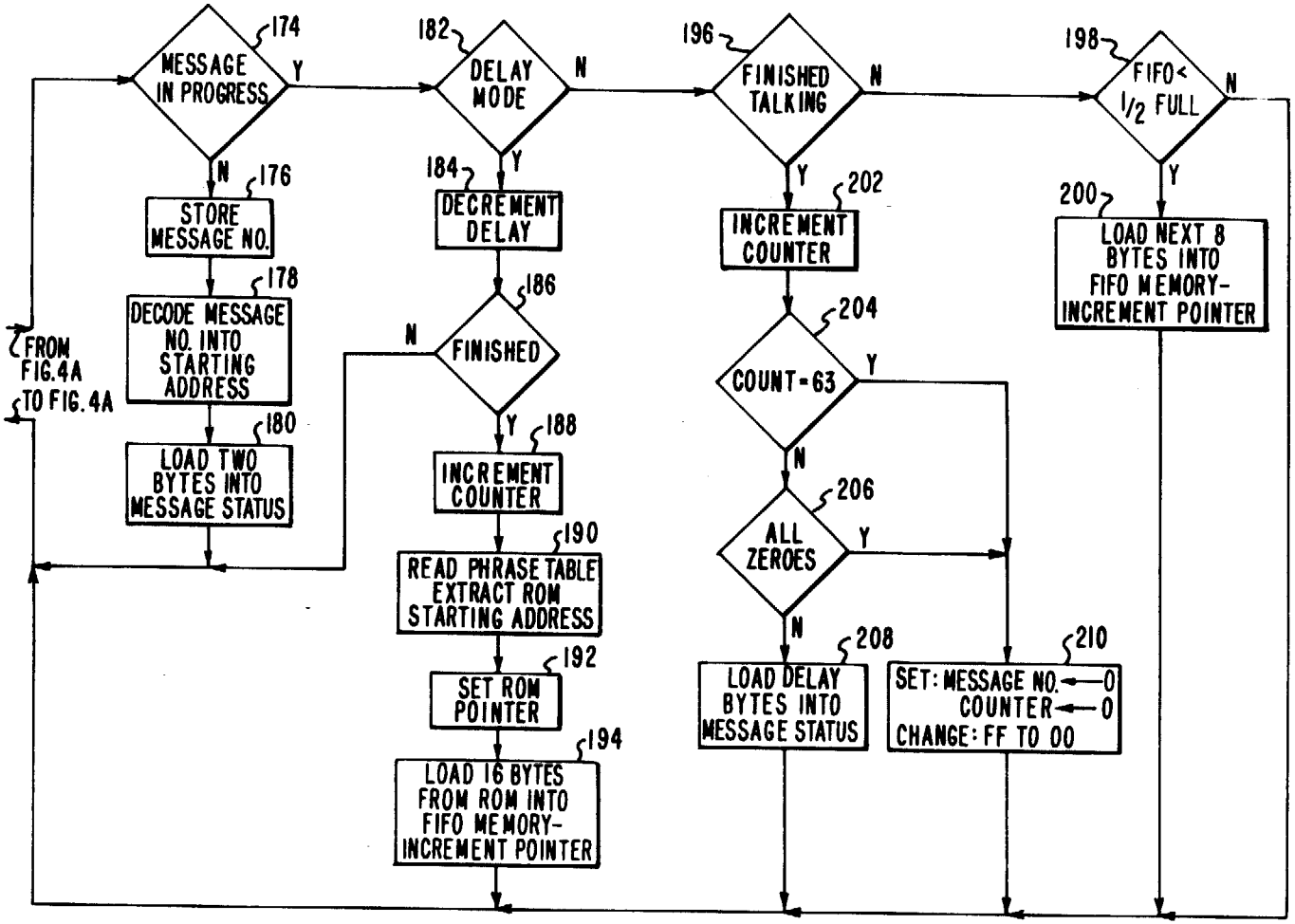
Figure 6:
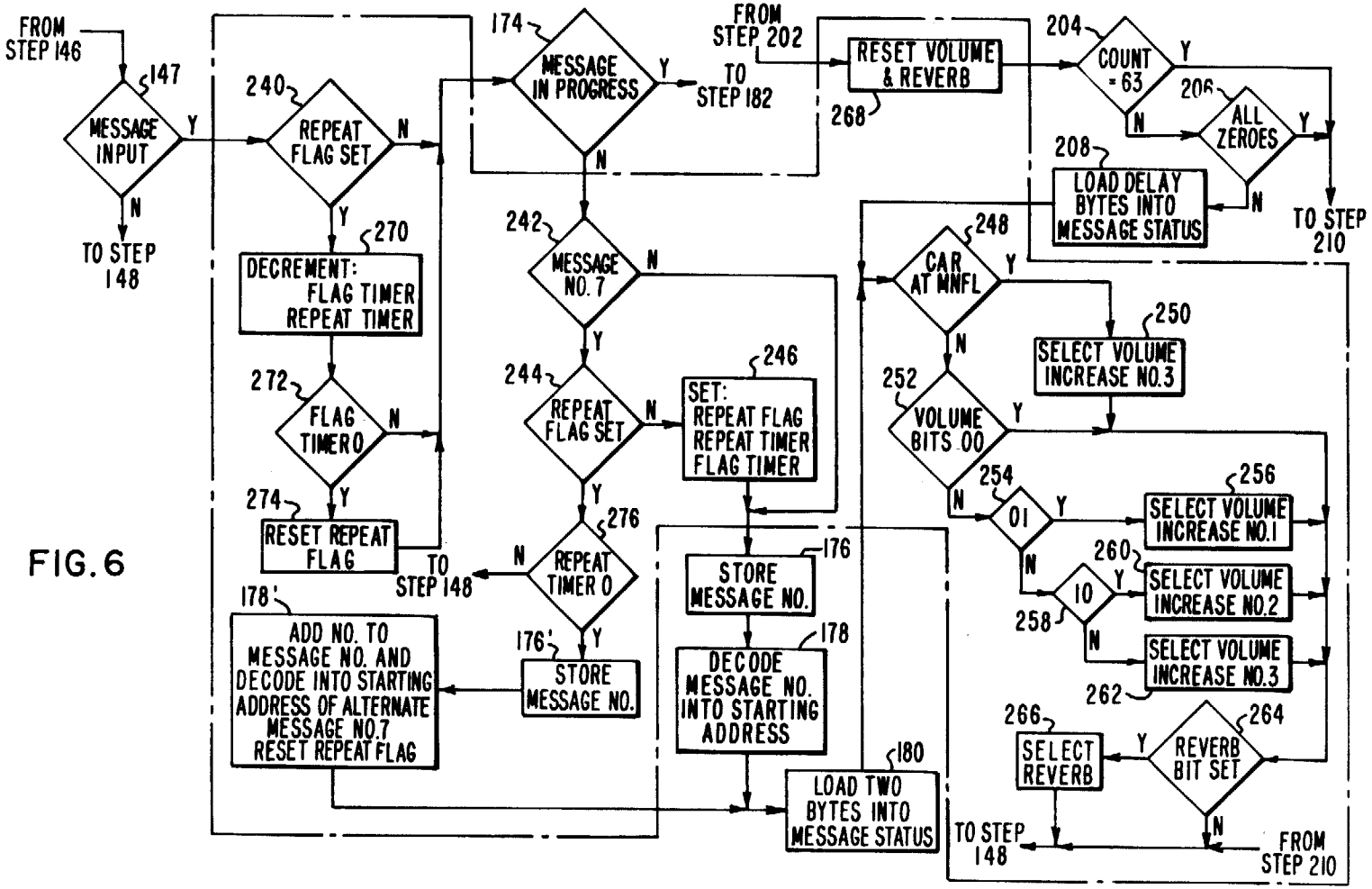
FIG. 6 is a flow chart which illustrates modifications and additions to the flow chart of FIGS. 4A and 4B, which may be used by a CPU in carrying out the teachings of the invention.

FIGS. 4A and 4B may be assembled to set forth a flow chart of an exemplary program which may be used by CPU 32 in implementing the teachings of the copending application. FIG. 6 illustrates the modification thereto required to provide an exemplary implementation of certain embodiments of the invention. The program is entered at 114 and the system is initialized at 116, such as by setting CARS to the number of cars in the system, such as four (100), by setting PORTS to the number of input ports per car, such as three (011), and by setting PORTNO to the number of terminals per input port, such as 24 (11000). The inputs from all of the cars are then successively read, starting with step 118, which reads the first input terminal of the first port of the first car (car A). Step 120 compares the reading with the last reading stored in RAM location 108 of FIG. 2. Step 121 determines if the signal has changed since the last reading. If it has, step 122 determines the nature of the change. If it changed from a 0 to a 1, step 123 stores a 1 at the proper bit location in RAM 38, and it sets the corresponding signal status word at memory location 110 of RAM 38 to FF (all 1's). If the change was from a 1 to a 0, step 124 stores a 0 at the proper bit position of RAM memory location 108.

Step 126 decrements PORTNO and step 128 checks to see if all of the input port terminals have been checked. If not, the program returns to step 118. If all 24 of the inputs of the port being considered have been checked, step 130 decrements PORTS, in order to check the inputs of the next input port. Step 132 checks to see if all of the input ports of the car being considered have been checked. If not, step 134 sets PORTNO to 24 (11000) and the program returns to step 118. When step 132 finds that all of the input ports have been checked, step 136 decrements CARS and step 138 checks to see if the inputs from all of the cars have been checked. If not, step 140 sets PORTS to 3 (011), step 134 sets PORTNO to 24 (11000), and the program returns to step 118. When step 138 finds all of the input ports of all of the cars have been checked, the program advances to the next phase of the program which checks the signal status of each car, memory location 110 of RAM 38.

More specifically, step 142 sets CSS to the number of cars, such as four (100), and step 144 sets SNO to the number of signal status words, i.e., 24 (11000). Step 146 checks to see if the first signal status word is all 1's (FF). If it is, step 147 checks to see if this is a message request input. If it is, the program advances to step 174. If step 146 finds that the signal status word is not FF, or step 147 finds it is not a message request input, step 148 decrements SNO and step 150 checks to see if all of the signal status words for the car being considered have been checked. If not, the program returns to step 146. If they have, step 152 decrements CSS and step 154 checks to see if all of the cars have been considered. If not, the program returns to step 144. If the signal status words of all of the cars have been checked, the program enters another phase, shown within broken outline 155, which updates the floor positions of the cars. Phase 155 is not required if the floor positions are given to CPU 32 from the cars. If the floor positions are not given to the CPU, the CPU can follow the cars via certain of the signals provided from the cars.

More specifically, step 156 checks to see if input signal B69 is true, indicating the car is located at the lowest floor. If so, the floor position counter, location 112 in RAM 38, is set to the lowest floor in step 158, and the program advances to step 172 to update the positions of the other cars. If signal B69 is not true, step 160 checks signal T69 to see if the car is located at the uppermost floor. If it is, step 162 sets the position counter to the count of the highest floor and the program advances to step 172. If the car is not located at either terminal, step 164 checks for a change in signal N, which changes logic level each time the car floor selector notches into another floor. If it has not changed since the last reading, the program advances to step 172. If it has changed, step 166 checks the car travel direction. Step 168 advances the floor position count if the car is traveling upwardly, and step 170 decrements the count when the car is traveling downwardly. Both steps 168 and 170 advance to step 172, to repeat the car position update steps for each of the remaining cars.

If step 146 found that a car signal status word was all 1's, and step 147 found that it relates to a message selection input, step 240, shown in FIG. 6, checks memory location 214 of FIG. 2 to see if the repeat flag has been set. As hereinbefore stated, this flag is set when a message is processed which is of the type subject to quick repetition, such as "Please allow the doors to close". It will first be assumed that the repeat flag has not been set. Step 174 then determines if this is the first detection of the message request by checking memory location 100 of RAM 38. If it is the first detection of the message request, location 100 will be 0's, and step 242 checks to see if this message is one subject to quick repetition, such as by checking to see if it is message No. 7, which will be assumed to be the message "Please allow the doors to close". If it is message No. 7, step 244 checks to see if the repeat flag has been set. If it has not, this is the first running of message No. 7, at least for a longer period of time than the value of a flag timer. Step 246 sets the repeat flag and it loads the respective count values for the repeat timer and flag timer into memory locations 212 and 216 of FIG. 2. The program then advances to step 176 to process the message in the "normal" manner.

Step 176 stores the message number at location 100 of RAM 38. CPU 32, in step 178, decodes the messsage number into the starting address for this message in the phrase table shown in FIG. 3, which is stored in ROM location 36. Step 180 loads the delay value found in the first two bytes of the phrase table found at the starting address for this message into location 104 of RAM 38 and it loads bits 13, 14 and 15 into RAM, such as adjacent to the repeat flag at memory location 214. This delay value, found at bits 0–11 of the message control word, determines the time length of the delay before the audio portion of the message begins.

Referring again to FIG. 6, step 180 advances to a part of the program to check several variations of the message parameters which may be implemented. For example, for floors which are known to have a high background noise level, such as the lobby, a higher volume may be selected for the message. Thus, step 248 may check to see if the car is located at the lobby or main floor by checking memory location 112 of FIG. 2. If it is, step 250 selects a higher volume level, such as volume increase No. 3, the highest volume available. CPU 32 then clocks flip-flops 224 and 226 via signal $\overline{\text{CXVOL}}$ as hereinbefore described. Other high noise floors may be checked at this time, and the volume increased accordingly if the car is found to be at any of these floors. The same is true for low noise floors.

If the car is not at the main floor, steps 252, 254 and 258 check the volume bits at memory location 214, and steps 256, 260 and 262 increase the volume, as required, as hereinbefore explained.

Step 264 then checks memory location 214 of FIG. 2 to see if the reverberation flag is set. If it is, step 266 selects the reverberation mode, as hereinbefore explained, and the program returns to step 148. If the reverberation bit is not set, the program returns to step 148.

If step 174 found that location 100 of RAM 38 was not 0's, indicating a message in progress, step 182 checks the second bit of the phrase table counter found at location 102 of RAM 38 to see if the message is in a delay mode. This bit position will be a zero when the message is in the delay mode. If it is a zero, step 184 decrements the delay value found at location 104 of RAM 38, and step 186 checks to see if the delay time has expired. If it has not expired, the program returns to step 148. If the delay has been completed, step 188 increments the phrase table counter at location 102 of RAM 38 to point to the address instruction for phrase 1 of the message. Step 190 extracts the starting ROM address for the first phrase of the message, and step 192 loads this address into location 106 of RAM 38 to form the pointer for ROM 34, which stores the digitized vocabulary or voice patterns. Step 194 then selects the proper car, such as car A, and it requests the "write" operation for its speech processor 50, as described relative to FIGS. 1A and 1B. Then, as fast as the speech processor 50 can take the information, CPU 32 loads the first 16 bytes of the vocabulary information from RAM 34 into the FIFO memory of the speech processor 50, incrementing the ROM pointer at memory location 106 with each byte. When it has completed this process, the program returns to step 148.

If step 182 finds that the second bit position of the count at memory location 102 is a 1, the message is not in the delay mode, but in a phrase mode, and step 196 determines if the speech processor 50 has completed the phrase by reading an appropriate bit in the speech processor. A code in the vocabulary information indicates to the speech processor when the phrase has been completed, and the speech processor sets a "finish talking" bit when this code is detected. If step 196 finds that the phrase has not been completed, step 198 reads the speech processor to determine if the FIFO memory is less than one-half full. If it is not, the program returns to step 148. If it is less than one-half full, step 200 loads the next eight bytes of vocabulary information from ROM 34 into the FIFO memory, starting with the address pointed to by the ROM pointer at memory location 106 of RAM 38, incrementing the ROM pointer with each byte. The program then returns to step 148.

If step 196 finds that the speech processor 50 has finished the phrase, step 202 increments the phrase table pointer (counter) at memory location 102 by two. Step 268, as shown in FIG. 6, resets the volume and reverberation flip-flops shown in FIG. 5. Step 204 checks to see if the count at location 102 has reached 63 (111111), indicating all 64 bytes of the message have been processed, and thus the message completed. If the count has not reached 63, step 206 determines if the next two bytes are all 0's, which also indicates completion of the message. If the message has not been completed, step 208 loads the next two bytes from the phrase table, the delay value, into memory location 104 of RAM 38, and the program returns to step 248 shown in FIG. 6. If either step 204 or step 206 found the message to have been completed, step 210 sets the message number to 0's, at memory location 100, it sets the phrase table counter to 0's at memory location 102, and it changes the appropriate signal status word at memory location 110 from FF to 00.

If the message is one which is being repeated within the predetermined period of time, step 240 in FIG. 6 will find the repeat flag at memory location 214 set, and step 270 will decrement the flag and repeat timers at memory locations 216 and 212, respectively. Step 272 then checks to see if the flag timer has expired. If it has, step 274 resets the repeat flag and advances to step 174. If it has not timed out, the program goes directly to step 174.

If step 174 found that a message was not in progress, step 242 found that the requested message is message No. 7, and step 244 found the repeat flag set, step 276 checks to see if the repeat timer has timed out. If it has not, it is too soon to repeat the message and the program returns to step 148. If the repeat timer has timed out, step 176' stores the message number at memory location 100, and step 178' decodes the message number with a value added thereto according to the location of an alternate message No. 7. As shown in FIG. 3, alternate message No. 7 may follow the end of the last message.

Alternate message No. 7 has at least one parameter varied from normal message No. 7. For example, one or more delays between phrases may be changed in length in order to emphasize a predetermined word, or words. For example:

Please—allow the doors to close.

or, the word order may be changed, such as:

Allow the doors to close please.

or, the message length and/or wording may be changed, such as:

Allow the doors to close.

or, predetermined words, or the whole message, may be increased in volume, such as:

PLEASE allow the doors to close, or

PLEASE ALLOW THE DOORS TO CLOSE.

or, predetermined words, or the whole message, may be reverberated.

Figure 7:
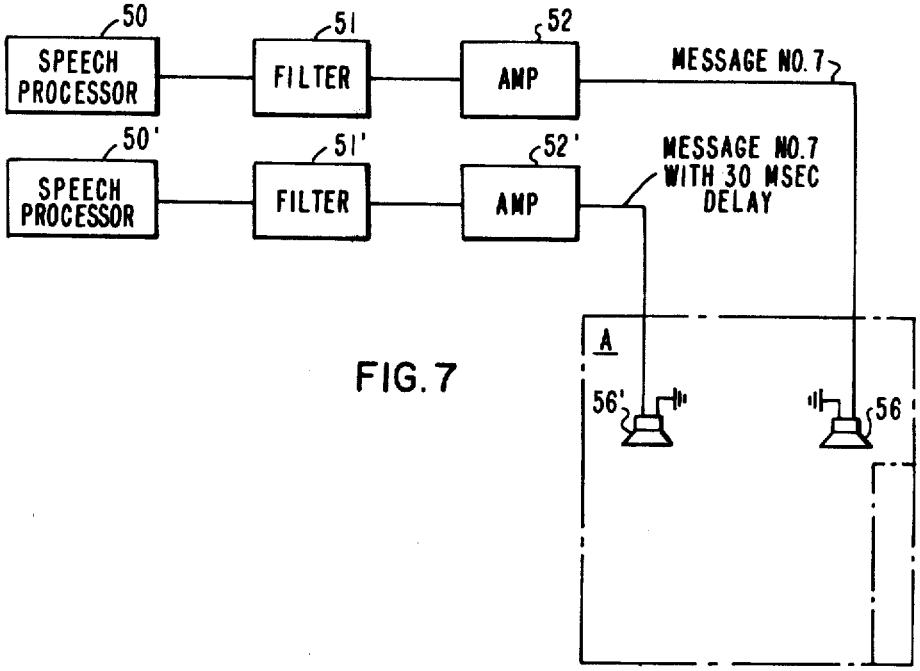
FIG. 7 is a schematic diagram which illustrates another arrangement for obtaining message reverberation.

Instead of using a reverberation unit, as shown in FIG. 5, FIG. 7 is a schematic diagram which illustrates that reverberation may also be accomplished by using two speakers 56 and 56' in the elevator car, with each speaker being connected to its own speech processor 50 and 50', respectively, via suitable filtering and amplification, as hereinbefore described. The message delivered by speech processor 50' is the same message as that being delivered by speech processor 50, but it is delayed by about 30 msec, to obtain the desired echo or reverberation effect.

Figure 8:
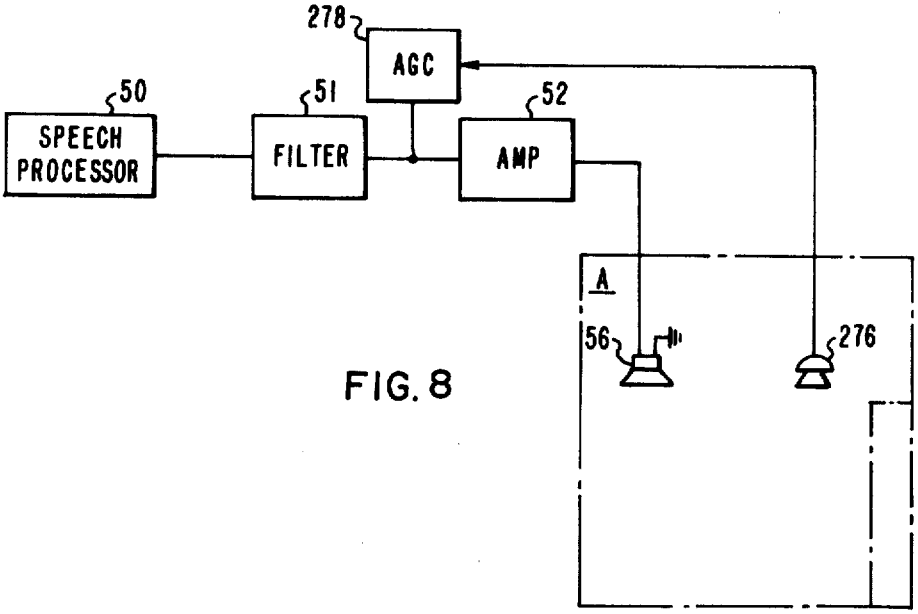
FIG. 8 is a schematic diagram which illustrates automatic control of message volume in response to the level of background noise.

As hereinbefore set forth, the message volume may be automatically increased, or decreased, at certain selected floors. FIG. 8 is a diagram of an arrangement which automatically adjusts the volume of the message according to the level of background noise, thus increasing the volume level at noisy floors, and reducing it at quiet floors. This may be accomplished by placing a microphone 276 in the elevator car and adjusting the signal strength applied to amplifier 52 via an automatic gain control circuit 278 which is responsive to the signal from the microphone.

We claim as our invention:

1. In an elevator system including an elevator car, control means for providing status signals indicative of the operation of the elevator car, and communication means for providing audible, informative messages in the elevator car in response to at least certain of its status signals, with the communication means including a central processor unit, memory means having a first location for storing a predetermined vocabulary common to all messages, and a second location for storing a series of instructions for each message, said communication means further including sound reproduction means and speech synthesizer means, with said speech synthesizer means having memory means for storing information from said first memory means, said central processor unit being responsive to the status signals from said elevator car and operating in response thereto to address the instructions in said second memory means, as required by a specific status signal, and using these instructions to extract vocabulary information from said first memory means and store it in the memory means of said speech synthesizer means, the improvement comprising:

said communication means including means for varying a predetermined parameter of at least one of the messages before the repetition thereof, with the variation being apparent when the same information is repeated following such variation, to prevent a monotonous repetition of exactly the same message information audibly delivered in exactly the same manner when a predetermined status signal results in the repetition of the same information, and/or to change the emphasis or urgency of the message.

2. The elevator system of claim 1 wherein the predetermined parameter is the delay time between at least certain of the words of the message.

3. The elevator system of claim 1 wherein the predetermined parameter is the use of a different word order for at least certain of the words.

4. The elevator system of claim 1 wherein the predetermined parameter is the number of words in the message.

5. The elevator system of claim 1 wherein the predetermined parameter is the volume of at least certain of the words.

6. The elevator system of claim 1 wherein the predetermined parameter is the reverberation of at least certain of the words in the message.

7. The elevator system of claim 6 wherein the varying means adds reverberation by connecting a reverberation unit into the communication system.

8. The elevator system of claim 6 wherein the communication means includes two speakers in the elevator car, with the varying means adding reverberation by supplying the identical message to both speakers, with one having about a 30 msec delay.

9. In an elevator system including an elevator car having doors for providing access thereto, control means for providing status signals indicative of the operation of the elevator car, and communication means for providing audible, informative messages in the elevator car in response to at least certain of its status signals, with the communication means including a central processor unit, memory means having a first location for storing a predetermined vocabulary common to all messages, and a second location for storing a series of instructions for each message, said communication means further including sound reproduction means and speech synthesizer means, with said speech synthesizer means having memory means for storing information from said first memory means, said central processor unit being responsive to the status signals from said elevator car and operating in response thereto to address the instructions in said second memory means, as required by a specific status signal, and using these instructions to extract vocabulary information from said first memory means and store it in the memory means of said speech synthesizer means, the improvement comprising:

said communication means including means for changing the volume of a message in response to the message being delivered while the elevator car is standing at a predetermined floor with its door open.

10. In an elevator system including and elevator car, control means for providing status signals indicative of the operation of the elevator car, and communication means for providing audible, informative messages in the elevator car in response to at least certain of its status signals, with the communication means including a central processor unit, memory means having a first location for storing a predetermined vocabulary common to all messages, and second location for storing a series of instructions for each message, said communication means further including sound reproduction means and speech synthesizer means, with said speech synthesizer means having memory means for storing information from said first memory means, said central processor unit being responsive to the status signals from said elevator car and operating in response thereto address the instructions in said second memory means, as required by a specific status signal, and using these instructions to extract vocabulary information from said first memory means and store it in the memory means of said speech synthesizer means, the improvement comprising:

said communication means including a microphone providing a signal responsive to background noise, and means responsive thereto for directly varying the volume of the message in response to the level of background noise.

* * * * *